United States Patent [19]

Davis

[11] 4,342,422

[45] Aug. 3, 1982

[54] HEATING AND COOLING SYSTEM USING FRICTIONAL AIR HEATING

[76] Inventor: Maxie C. Davis, Rte. 8, Box 61, Mooresville, N.C. 28115

[21] Appl. No.: 197,491

[22] Filed: Oct. 16, 1980

[51] Int. Cl.[3] ..... F24H 1/22

[52] U.S. Cl. ..... 237/19; 62/148; 62/159; 62/238.3

[58] Field of Search ..... 62/79, 148, 159, 238.3; 165/63; 237/2 B, 19; 66/324.2, 324.4

[56] References Cited

U.S. PATENT DOCUMENTS

| | | | |
|---|---|---|---|
| 1,682,102 | 8/1928 | Allen . | |
| 2,497,184 | 2/1950 | O'Brien | 237/19 X |
| 2,533,508 | 12/1950 | Riu | 237/19 X |
| 3,245,399 | 4/1966 | Lawson . | |
| 3,278,122 | 10/1966 | Laing | 237/19 |
| 3,297,019 | 1/1967 | Lawson . | |
| 3,467,179 | 9/1969 | Tevis et al. . | |
| 3,481,322 | 12/1969 | Hokanson, Sr. et al. . | |
| 3,958,552 | 5/1976 | Lawler . | |
| 3,977,387 | 8/1976 | Lawler . | |
| 4,037,649 | 7/1977 | Hartka | 62/159 |
| 4,251,997 | 2/1981 | Newton | 62/148 X |

*Primary Examiner*—Lloyd L. King

*Attorney, Agent, or Firm*—Bell, Seltzer, Park & Gibson

[57] ABSTRACT

A compact, self-contained highly efficient frictional air heating unit is provided which draws a flow of ambient air through an air inlet, frictionally heats the air, and discharges the air through an air outlet. The frictional air heating unit is utilized in a heating and cooling system for providing a source of heated air for heating, for powering an absorption type air conditioner system for cooling, and for heating water.

10 Claims, 6 Drawing Figures

HEATING AND COOLING SYSTEM USING FRICTIONAL AIR HEATING

BACKGROUND OF THE INVENTION

This invention relates to an air heating unit in which air is heated by means of friction, and to a heating and cooling system which uses such an air heating unit.

It is known that a rotating fan rotor can be utilized to frictionally heat air to an elevated temperature, and various prior patents have disclosed applications of this general principle. Note for example the following prior U.S. Pat. Nos. 1,682,102; 3,297,019; 3,245,399; 3,467,179; 3,481,322; 3,958,552; and 3,977,387.

It is an object of the present invention to provide an improved air heating unit in which air is heated by means of friction and which has a number of advantages over the frictional air heating units heretofore proposed.

A more specific object of this invention is to provide a frictional air heating unit which more effectively utilizes all of the energy input for heating the air so as to thereby provide a considerably enhanced operating efficiency.

Another object of this invention is to provide a heating and cooling system suitable for heating or cooling buildings and which utilizes this improved frictional air heating unit.

A further object of this invention is to provide a heating and cooling system of the type described which is also capable of supplying heated water.

SUMMARY OF THE INVENTION

In accordance with the present invention, there is provided a frictional air heating unit which is of compact and self-contained construction and of highly efficient operation and which comprises a hollow enclosure within which there is mounted a frictional heating device which is operable for drawing a flow of ambient air into the enclosure through an air inlet and which frictionally heats the air and discharges the heated air through an air outlet. This frictional heating device comprises an electric motor which is positioned within the enclosure and in the path of flow of the air which is drawn into the enclosure so that the motor is cooled by the flow of air while the heat from the motor is effectively captured and utilized for preheating the incoming air. A fan rotor is mounted on the shaft of the motor and includes a series of radially extending vanes for creating a flow of air upon rotation of the rotor by the motor shaft. A rotor housing closely surrounds the rotor and cooperates therewith so that a quantity of air is trapped in close proximity to the rotor, and the rotational movement of the rotor and the resulting air movement produces frictional heating of the air within the rotor housing. The rotor housing is positioned within the enclosure with its exterior in the path of flow of the air which is drawn into the enclosure so that the heated exterior of the housing also serves for preheating the air which is drawn into the enclosure and which circulates past the rotor housing. An air inlet opening is formed in the rotor housing and communicates with the hollow interior of the enclosure for admitting the partially preheated air from the interior of the enclosure into the rotor housing, and an outlet opening is formed in the rotor housing for discharging the frictionally heated air from the rotor housing. A conduit associated with the outlet opening of the rotor housing extends through the interior of the enclosure and discharges a flow of heated air from the enclosure.

The above-described air heating unit is used in conjunction with a heating and cooling system which provides for the heating of water as well as for either heating or cooling air which is circulated through a building. More specifically, the heating and cooling system includes an absorption type air conditioning system. The heated air which is discharged from the frictional air heating unit is directed through a heat exchanger forming a part of the absorption air conditioning system and serves for heating and vaporizing an ammonia-water mixture. The ammonia vapors are condensed and thereafter expanded in a known manner to absorb heat from and thereby cool a flow of air in a duct system serving a building. The heated air from the frictional air heating unit is also directed through a coil which is immersed in a water heating tank and is thus utilized for heating the water to provide a source of domestic hot water. When heating of the building is desired rather than cooling, the heated air from the frictional air heating unit bypasses the heat exchanger of the absorption air conditioning unit and is directed into the duct system serving the building for thereby providing a source of heated air to the building.

BRIEF DESCRIPTION OF THE DRAWINGS

Some of the objects, features and advantages of the invention having been stated, others will appear as the description proceeds, when taken in connection with the accompanying drawings, in which.

DESCRIPTION OF ILLUSTRATED EMBODIMENT

Figure 1:
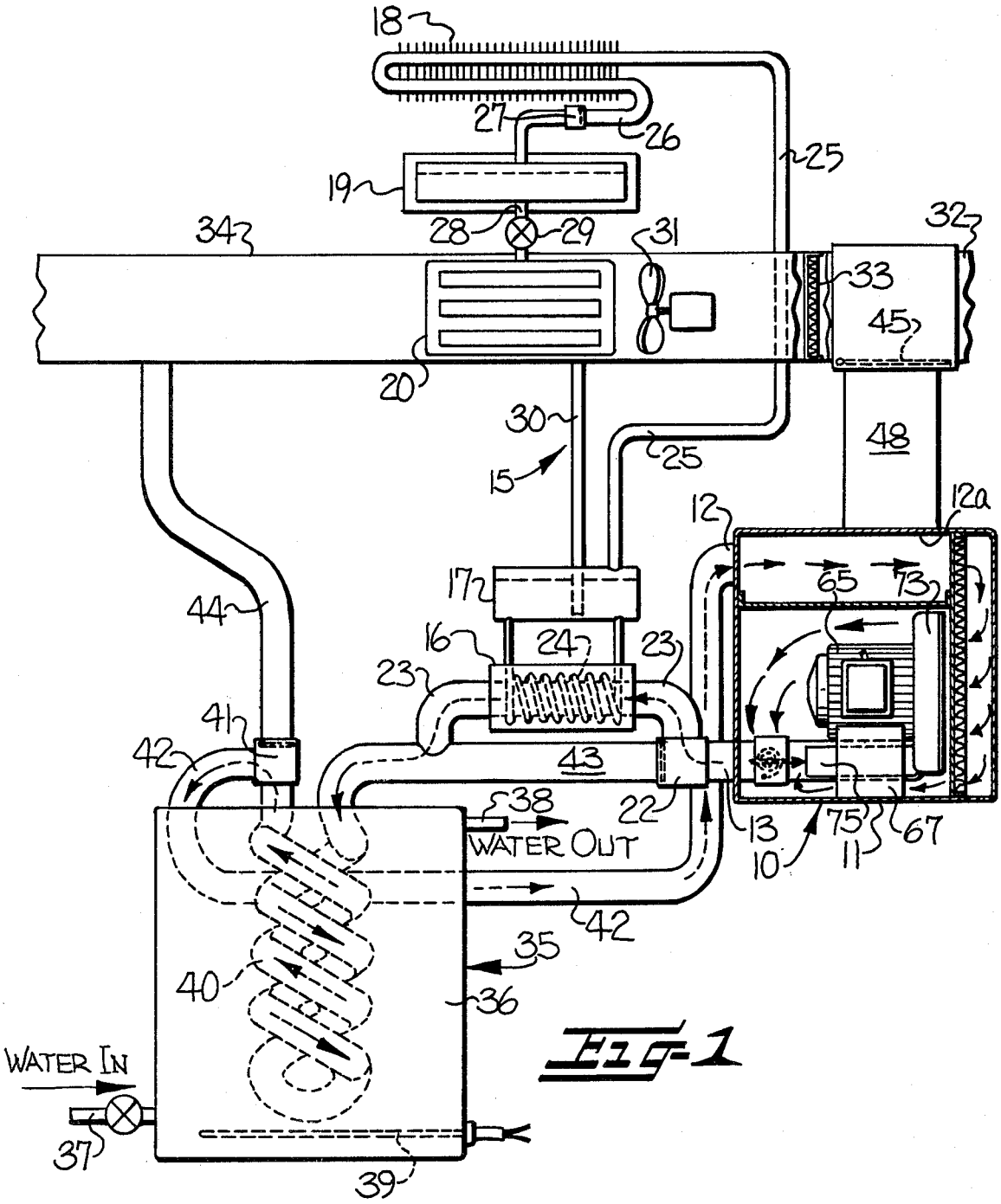
FIG. 1 is a schematic illustration of a heating and cooling system using the frictional air heating unit of this invention.
Figure 2:
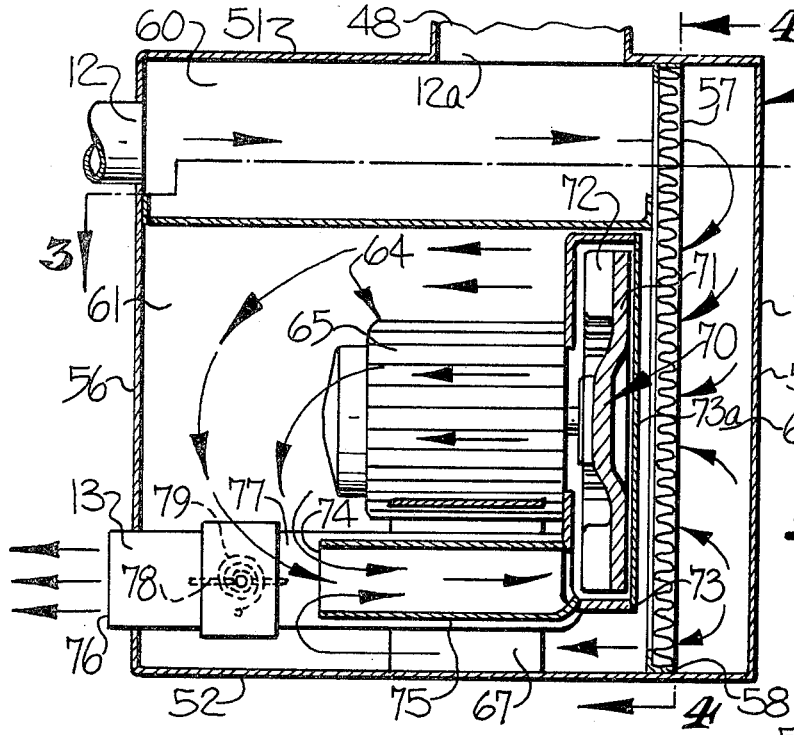
FIG. 2 is a cross-sectional side elevational view of the frictional air heating unit.
Figure 3:
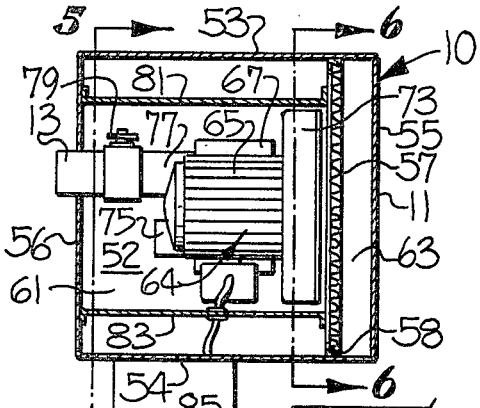
FIG. 3 is a cross-sectional plan view of the unit taken substantially along the line 3—3 of FIG. 2.
Figure 4:
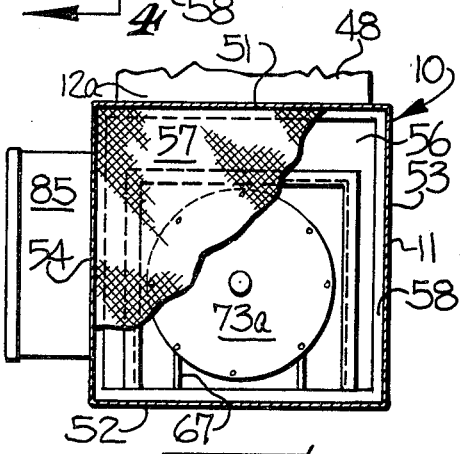
FIG. 4 is a cross-sectional elevational view of the unit taken substantially along the line 4—4 of FIG. 2.
Figure 5:
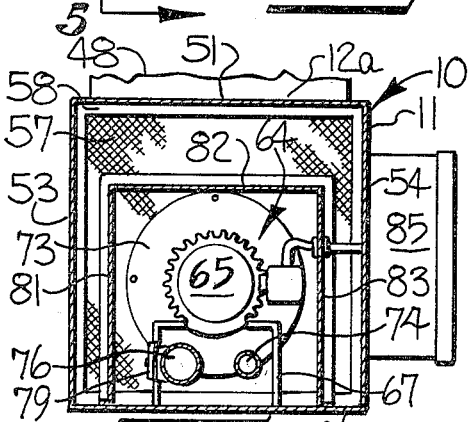
FIG. 5 is a cross-sectional elevational view taken substantially along the line 5—5 of FIG. 3.
Figure 6:
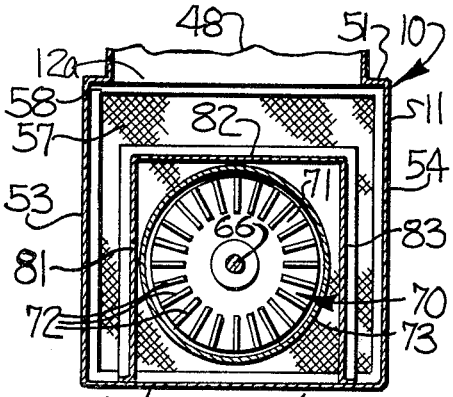
FIG. 6 is a cross-sectional elevational view taken substantially along the line 6—6 of FIG. 3.

In FIG. 1 there is schematically illustrated a heating and cooling system using the frictional air heating unit of this invention. The frictional air heating unit is generally indicated by the reference character 10 and includes an enclosure 11 having an air inlet 12 through which ambient air is drawn into the enclosure and having an air outlet 13 from which heated air is discharged from the unit. The construction and operation of the frictional air heating unit 10 will be explained more fully later. At this point, it is sufficient to note that the heated air is discharged from the air outlet 13 at a relatively high volumetric flow rate and at a relatively high temperature on the order of about 150° to 300° F.

In the heating and cooling system illustrated, the heated air from the air heating unit 10 is utilized for heating water and for either heating or cooling a building. The system will first be explained as it operates during its cooling function. As illustrated, the air heating unit 10 is used in conjunction with an absorption type air conditioning system, which is generally indicated by the reference character 15. The air conditioning system 15 includes a heat exchanger 16, a generator 17, an air cooled condenser coil 18, a liquid receiver 19, and an evaporator coil 20. Heated air from the air outlet 13 of the air heating unit 10 passes through a two-way valve 22 and along a duct 23 to the heat exchanger 16 where an ammonia and water solution contained in a coiled conduit 24 is heated by the flow of heated air. The heated ammonia and water solution circulates between the heat exchanger 16 and the generator 17. The heating of the ammonia and water solution causes ammonia gas to be driven off. The ammonia gas flows along a conduit 25 to the condenser 18 where the gas is condensed to a liquid. The liquid then passes along a conduit 26, through a one-way check valve 27 and to the liquid receiver 19. The liquid then flows from the liquid receiver 19 through a conduit 28 and through an expansion valve 29 where the liquid expands and vaporizes, absorbing heat in the evaporator coil 20. The ammonia is then returned along conduit 30 to the generator 17 where it recombines with the ammonia and water mixture, is reheated, and the cycle is repeated. Air from the building is drawn by a fan 31 through a return air duct 32 and through a filter 33. The air passes over the evaporator coil 20 and is cooled, and is then directed back to the building by a supply air duct 34.

The heated air from the air heater unit 10, after passing through the heat exchanger 16, is directed to a water heater generally indicated by the reference character 35. The water heater 35 comprises a tank 36 having a water inlet 37 and a water outlet 38. The heated air from duct 23 passes through a coil 40 which is immersed in the water in tank 36 and serves for heating the water in the tank 36. The heated air leaves the water heater 35, passes through a two-way valve 41, and along a duct 42 where the air is returned to the air inlet 12 of the air heating unit 10. The water heater 35 may optionally include a supplemental electric heating element 39 for use in combination with the coil 40 when necessary or desirable, or for use in providing heated water when the heating unit 10 is not in operation.

When air cooling is not needed, the valve 22 is moved from the position shown in dotted lines to direct the heated air from the air outlet 13 along a branch conduit 43 and directly to the coil 40 of the water heater 35.

In order to use the air heating unit 10 in the heating cycle for heating a building, the valve 41 is moved from the position shown in broken lines to allow the heated air from the coil 40 to flow along a conduit 44 and to the air supply duct 34. Valve 45 located in the return air duct system is moved from the position shown in broken lines to direct a portion or all of the air flowing from the return air duct 32 through a branch duct 48 and into the air inlet **12*a* of the air heating unit. The heated air flows from the water heater 35 along duct 44 and to the heated air supply duct 34**.

Referring now in more detail to the construction of the air heating unit 10, as best seen from FIGS. 2 to 6, the enclosure 11 is formed by opposing pairs of interconnected walls, including an upper wall 51, a lower wall 52, opposing side walls 53, 54 and opposing end walls 55, 56. An air inlet 12 is located in the end wall 56 and is connected to the duct 42 for receiving the air returned from coil 40. An air inlet **12*a* is also located in the upper wall 51 and connected to the branch duct 48 for receiving the air from the return air duct 32. Partition walls 81, 82 and 83 are mounted within the enclosure 11 in a generally U-shaped arrangement in inwardly spaced parallel relation with the side walls 53, 54 and with upper wall 51. These partition walls 81, 82, 83 define within the interior of the enclosure an outer air chamber 60 of a generally U-shaped configuration located between the walls 51, 53 and 54 of the enclosure and the partition walls 81, 82 and 83 and an interior air chamber 61 located interiorly of the partition walls and in which a frictional air heating means or device 64** is mounted.

A filter 57 is mounted within the enclosure 10 and is located interiorly of and extending generally parallel to the end wall 55. The filter has a cross-sectional area substantially corresponding to the cross-section of the interior of the enclosure and extends between the opposing upper and lower walls 51, 52 and the opposing side walls 53, 54. The filter 57 thus extends across and forms one end of the interior air chamber 61 and the surrounding outer air chamber 60. The filter is held in place by a mounting flange 58 which engages the filter around its perimeter. The space between the filter 57 and the adjacent end wall 55 serves as an air filtering chamber 63, and provides communication between the outer air chamber 60 and the interior air chamber 61 so that ambient temperature air drawn into the enclosure 10 through the air inlet 12 or **12*a* will flow successively through the outer chamber 60, through the filter 57 and into the filtering chamber 63, and then through the filter 57 a second time and into the interior air chamber 61. The air heating device 64 withdraws air from the interior air chamber 61, heats the air by friction, and discharges the heated air from the enclosure via the outlet 13**.

The air heating device 64 more particularly includes an electric motor 65 having a shaft 66 extending from one end thereof. The motor is mounted in the path of flow of the air through the chamber 61 so that the movement serves to cool the motor 65 while the heat from the motor serves for preheating the air. The motor 65 is mounted to the enclosure by a mounting base 67. A fan rotor 70 is mounted for rotation on the shaft 66 of the electric motor 55. The fan rotor 70 includes a circular generally disclike base portion 71 and has a series of integrally formed vanes 72 which project axially from one face of the base portion 71 and which, unlike most conventional fan vanes or blades which are generally curved or inclined, extend directly in a radial direction.

More particularly, it will be seen that the vanes 72 are generally flat, and have a radial extent or length of about one-half the radius of the circular base portion 71. The outer radial extent of the vanes 72 are coextensive with the circumferential periphery of the base portion 71. The flat vanes 71 lie in radially extending planes which intersect the axis of the rotor. This radial orientation of the vanes with the absence of any pitch or incline permits the rotor to operate at a high rate of speed for centrifugally moving the air and frictionally heating the same, but without causing an undue load or strain on the motor, regardless of the inlet and outlet pressure conditions.

The fan rotor 70 is closely surrounded on all sides by a rotor housing 73 which serves to confine the air in the vicinity of the rotating vanes of the fan rotor and to thereby bring about frictional heating of the air. An air inlet opening 74 and an associated air inlet conduit 75 communicate with the interior of the rotor housing and with the interior air chamber 61 and serve to allow fresh air to be drawn from the interior air chamber 61 into the rotor housing 73. An air outlet opening 76 permits the heated air to be discharged from the rotor housing. Preferably, and as illustrated, the air inlet opening 74 is of smaller cross-sectional area than the air outlet opening 76. Most desirably, the inlet diameter is about one-half the outlet diameter and the ratio of inlet area to outlet area is therefore about 1:4. By this arrangement, air is drawn into the housing through the air inlet opening 74 under a partial suction pressure, is recirculated in the housing in frictional contact with the rotating rotor while the mechanical energy of the rotating rotor vanes is converted into heat energy and serves to heat the air. The heated air is discharged from the rotor housing 73 through the air outlet opening 76. A conduit 77 extends from the outlet opening 76 of the rotor housing to the exterior of the enclosure 10 and serves to form the outlet 13 of the enclosure 10 where the heated air is discharged.

Preferably, and as illustrated, means is provided in the outlet conduit 77 to form a variable restriction to the flow of air. In the illustrated embodiment, this variable restriction is provided by a pivotally mounted butterfly valve 78 which can be pivotally adjusted for providing any desired restriction to air flow. The pivotal adjustment of the valve 78 is controlled by a bimetallic spring element 79 which is so connected to the valve 78 as to pivotally adjust the valve 78 in response to temperature. At relatively low temperatures, the bimetallic spring element 79 biases the valve 78 relatively strongly toward a closed position for providing a relatively large restriction to the flow of air. Thus, at relatively low temperatures, as for example during start-up, a relatively large restriction to air flow is imposed and this serves to achieve more rapid heating to operating temperature. As the temperature increases, the bimetallic spring element 79 reduces the bias on the valve 78 and thus provides a lesser restriction to the flow of air. At all times, the valve 78 is freely movable and the pressure of the air generated by the fan rotor 70 can override the valve 78 to allow air to be discharged from the outlet 13.

It will be noted that the rotor housing 73 has a cover plate **73*a* on one side thereof which can be removed to provide access to the rotor. The rotor housing 73 is mounted so that the cover plate 73*a* is in spaced relation to the filter 57 so that air passing through the filter 57 and entering the air chamber 61 must pass over the rotor housing. The heated exterior of the housing 73 thus serves to preheat the air which is drawn into the air chamber 61** to thereby maximize the efficiency and effectiveness of operation of the air heating device.

It will also be noted that the electric motor 65, the rotor housing 73 and the outlet conduit 77 are all mounted in inwardly spaced relation from the partition walls 81, 82, 83. These elements all serve to preheat the air within the interior air chamber 61 before it is drawn into the rotor housing 73 and further heated. This also serves to keep the walls of the enclosure at a comfortable and safe temperature. Additionally, enclosing the frictional heating means 49 within the partition walls serves to dampen and reduce the level of noise transmitted to the surroundings.

An electric control box 85 is mounted on the outside of the enclosure and houses suitable electric relays or other controls needed for operation of the motor. The electric wiring extends from the control box 85 to the motor inside the enclosure.

In the drawings and specification, there has been set forth a preferred embodiment of the invention, and although specific terms are employed, they are used in a generic and descriptive sense only and not for purposes of limitation.

That which is claimed is:

1. An apparatus for heating air comprising an enclosure having an air inlet and an air outlet; and frictional heating means mounted within said enclosure and operable for drawing a flow of air into the enclosure through said inlet, frictionally heating the air, and discharging the heated air through said outlet; said frictional heating means comprising an electric motor having a rotatable shaft, said motor being positioned in the path of flow of the air which is drawn into said enclosure so that the motor is cooled by the flow of air while the heat from the motor serves for preheating the air; a fan rotor carried by said motor shaft and including a series of radially extending vanes for creating a flow of air upon rotation of the rotor by said motor shaft; a rotor housing closely surrounding said fan rotor and cooperating therewith so that the rotational movement of the fan rotor and the resulting air movement produces frictional heating of the air within said rotor housing, said rotor housing being positioned with the exterior thereof in the path of flow of the air which is drawn into said enclosure so that the heated exterior of the housing also serves to preheat the air which is drawn into said enclosure; an air inlet opening formed in said rotor housing and communicating with the interior of said enclosure for admitting air from the interior of the said enclosure into said rotor housing; an air outlet opening formed in said rotor housing for discharging heated air from the rotor housing; and a conduit communicatively connected to said air outlet opening of said rotor housing and extending therefrom to said outlet of said enclosure for thereby discharging a flow of heated air from the enclosure.

2. An apparatus as set forth in claim 1 wherein the air inlet opening of said rotor housing is of a substantially smaller cross-sectional area than the area of the air outlet opening of said rotor housing.

3. An apparatus as set forth in claim 1 including means associated with said conduit and defining a variable restriction to the flow of air therethrough.

4. An apparatus as set forth in claim 3 wherein said means defining a variable restriction to the flow of air includes temperature responsive means operable for providing a relatively large restriction to air flow at relatively low temperatures and for providing a substantially smaller restriction to air flow at higher temperatures.

5. An apparatus as set forth in claim 1 including a filter mounted within said enclosure, said filter being located between said air inlet of the enclosure and said heating means and serving for filtering the air prior to entering the air inlet opening of said rotor housing.

6. An apparatus as set forth in claim 1 wherein said fan rotor is of a disclike configuration and said series of vanes are integrally formed therewith and extend radially on one side thereof.

7. An apparatus for heating air comprising a hollow enclosure defined by pairs of opposing walls, said enclosure having an air inlet and an air outlet; frictional heating means mounted within said enclosure and operable for drawing a flow of air into the enclosure through said inlet, frictionally heating the air and discharging the heated air through said outlet; partition means located interiorly of said enclosure adjacent to and surrounding said frictional heating means and defining an inner air chamber surrounding said frictional heating means and an outer air chamber between said partition means and the walls of said enclosure, said air inlet of said enclosure communicating with said outer air chamber; means providing communication between said outer air chamber and said inner air chamber; and means providing communication between said inner air chamber and said outlet of the enclosure whereby air is admitted first into said outer air chamber and then flows into said inner air chamber and is then discharged from said enclosure through said air outlet; said heating means comprising an electric motor having a rotatable shaft, a fan rotor carried by said motor shaft and including a series of radially extending vanes for creating a flow of air upon rotation of the fan rotor by said motor shaft, a rotor housing closely surrounding said fan rotor and cooperating therewith so that the rotational movement of the rotor and the resulting air movement produces frictional heating of the air within said rotor housing, an air inlet opening formed in said rotor housing and communicating with said inner air chamber for admitting air from said inner air chamber into said rotor housing and an air outlet opening formed in said rotor housing and cooperating with said means providing communication between said inner air chamber and said air outlet of the enclosure for discharging heated air from the rotor housing and outwardly through the outlet of said enclosure.

8. An apparatus as set forth in claim 7 wherein said motor and said rotor housing are both positioned in the path of flow of the air which is drawn into said inner air chamber so that the motor and the rotor housing are cooled by the flow of air while heat from the motor and the rotor housing serves for preheating the air prior to entering the air inlet of said rotor housing.

9. An apparatus as set forth in claim 7 wherein said means providing communication between said outer chamber and said inner chamber comprises filter means cooperating with said outer chamber and said inner chamber for filtering the air flowing from said outer chamber to said inner chamber.

10. An apparatus as set forth in claim 9 wherein said filter means includes a filter element having a flow area corresponding substantially to the cross-sectional area of said enclosure, and said filter means cooperates with said outer and inner air chamber such that the air flowing from the outer chamber to the inner chamber passes twice through said filter element in flowing from said outer air chamber to said inner air chamber.

* * * * *